US009709064B2

(12) United States Patent
Tsai et al.

(10) Patent No.: US 9,709,064 B2
(45) Date of Patent: Jul. 18, 2017

(54) INTEGRATED FAN BLADE AND FAN HAVING THE SAME

(71) Applicant: COOLER MASTER CO., LTD., New Taipei (TW)

(72) Inventors: Shui-Fa Tsai, New Taipei (TW); Shih-Wei Huang, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 404 days.

(21) Appl. No.: 14/478,735

(22) Filed: Sep. 5, 2014

(65) Prior Publication Data

US 2015/0118081 A1 Apr. 30, 2015

(30) Foreign Application Priority Data

Oct. 24, 2013 (CN) ..... 2013 2 0660358 U

(51) Int. Cl.

| | |
|---|---|
| ***F04B 35/04*** | (2006.01) |
| ***F04D 25/02*** | (2006.01) |
| ***F04D 25/06*** | (2006.01) |
| ***F04D 17/16*** | (2006.01) |
| ***F04D 29/28*** | (2006.01) |

(Continued)

(52) U.S. Cl.

CPC ..... *F04D 25/026* (2013.01); *F04D 17/08* (2013.01); *F04D 17/16* (2013.01); *F04D 25/064* (2013.01); *F04D 25/0633* (2013.01); *F04D 25/0653* (2013.01); *F04D 29/281* (2013.01); *F04D 29/4226* (2013.01)

(58) Field of Classification Search

CPC ..... F04D 17/08; F04D 17/16; F04D 25/026; F04D 25/0653; F04D 25/064; F04D 29/281; F04D 29/4226

USPC ..... 417/354

See application file for complete search history.

(56) References Cited

U.S. PATENT DOCUMENTS 6,923,619 B2 * 8/2005 Fedoseyev ..... F04D 25/066 361/697

8,360,747 B2 * 1/2013 Horng ..... F04D 25/0653 310/156.32

(Continued)

FOREIGN PATENT DOCUMENTS

DE 44 11 960 * 10/1995

OTHER PUBLICATIONS

Machine Translation of DE 44 11 960.*

*Primary Examiner* — Charles Freay

(74) *Attorney, Agent, or Firm* — Muncy, Geissler, Olds & Lowe, P.C.

(57) ABSTRACT

An integrated fan blade and a fan having the same are provided. The fan includes a stator (1) and a fan blade (2); the stator (1) is provided with a stator pivoting member (10) and disposed on and electrically connected to a circuit board (11); the fan blade (2) includes a blade wheel (20), a fan blade pivoting member (21) formed at the center of the blade wheel (20) and axially extended; and a plurality of blade pieces (22) annularly formed at the outer periphery of the blade wheel (20), and the fan blade pivoting member (21) is pivoted with the stator pivoting member (10), wherein the fan blade (2) is formed with a magnetic material area and formed through an integrally forming means. With the fan blade (2) being integrally formed, the fan operating property can be effectively improved.

10 Claims, 5 Drawing Sheets

(51) Int. Cl.
*F04D 17/08* (2006.01)
*F04D 29/42* (2006.01)

(56) References Cited

U.S. PATENT DOCUMENTS

2007/0104593 A1* 5/2007 Yamaguchi ..... F04D 29/281
417/354
2011/0290456 A1* 12/2011 Huang ..... F04D 25/0693
165/121
2013/0039784 A1* 2/2013 Teubel ..... F04D 29/026
417/355
2013/0064700 A1* 3/2013 Wu ..... F04D 17/16
417/423.7
2015/0301567 A1* 10/2015 Chen ..... G06F 1/203
417/354

* cited by examiner

INTEGRATED FAN BLADE AND FAN HAVING THE SAME

BACKGROUND OF THE INVENTION

Field of the Invention

The present invention relates to a heat dissipation fan, especially to an integrated fan blade and a fan having the same.

Description of Related Art

The computer-related industries have been well developed, and a fan becomes a must have component in a computer for the purpose of heat dissipation. The fan is served to provide a heat dissipation function; however, with the trend of the computer or other electronic device being smaller and thinner, the space and volume for installing the fan is limited and the fan may also be required to be lighter in weight.

A conventional heat dissipation fan mainly includes a stator and a rotor; wherein the rotor is a fan blade of the fan, and the fan blade is formed with at least a blade wheel and a plurality of blade pieces formed at the outer periphery of the blade wheel, and a magnetic member is disposed in the blade wheel for generating electromagnetic induction with the stator. Meanwhile, the center of the blade wheel is installed with an axis or a sleeve for the purpose of pivotal connection. As such, the structure of conventional fan is not simplified and connection structures for connecting each component are required; moreover, each component is made of material having heavier weight, so an objective of being lighter cannot be achieved; furthermore, the assembly procedure is relatively complicated thereby causing the production cost unable to be lowered.

Accordingly, the applicant of the present invention has devoted himself for improving the mentioned disadvantage.

SUMMARY OF THE INVENTION

The present invention is to provide an integrated fan blade and a fan having the same, in which a magnetic material is adopted for integrally forming the above-mentioned fan blade, so the weight of the fan blade is able to be lighter through being made of single material, and advantages of lowering production cost, effectively improving the fan operation property and ensuring the product quality are provided.

Accordingly, the present invention provides an integrated fan blade, which includes:

- a blade wheel;
- a fan blade pivoting member formed at the center of the blade wheel and axially extended; and
- a plurality of blade pieces annularly formed at the outer periphery of the blade wheel;
- wherein, the blade wheel, the fan blade pivoting member and the blade pieces are integrally formed in one piece with a magnetic material area.

According to the integrated fan blade provided by the present invention, the magnetic material area is formed at the periphery of the blade wheel and composed of a plurality of N-pole zones and a plurality of S-pole zones being annularly and staggeringly arranged.

According to the integrated fan blade provided by the present invention, the magnetic material area is formed on the top surface of the blade wheel and composed of a plurality of N-pole zones and a plurality of S-pole zones being annularly and staggeringly arranged.

According to the integrated fan blade provided by the present invention, the magnetic material area is formed on the blade pieces and composed of a plurality of N-pole zones and a plurality of S-pole zones.

According to the integrated fan blade provided by the present invention, the magnetic material area is provided with magnetic powders.

Accordingly, the present invention provides a fan having an integrated fan blade, which includes:

- a stator, provided with a stator pivoting member, and disposed on a circuit board and electrically connected to the circuit board; and
- a fan blade, including a blade wheel, a fan blade pivoting member formed at the center of the blade wheel and axially extended, and a plurality of blade pieces annularly formed at the outer periphery of the blade wheel, and the fan blade pivoting member is pivoted with the stator pivoting member;
- wherein, the fan blade is integrally formed with a magnetic material area.

According to the fan having the integrated fan blade provided by the present invention, the magnetic material area is formed at the periphery of the blade wheel and composed of a plurality of N-pole zones and a plurality of S-pole zones being annularly and staggeringly arranged.

According to the fan having the integrated fan blade provided by the present invention, the magnetic material area is formed on the top surface of the blade wheel and composed of a plurality of N-pole zones and a plurality of S-pole zones being annularly and staggeringly arranged.

According to the fan having the integrated fan blade provided by the present invention, the magnetic material area is formed on the blade pieces and composed of a plurality of N-pole zones and a plurality of S-pole zones.

According to the fan having the integrated fan blade provided by the present invention, the magnetic material area is provided with magnetic powders.

According to the fan having the integrated fan blade provided by the present invention, the stator is composed of a silicon steel sheet being wound with coils.

According to the fan having the integrated fan blade provided by the present invention, the stator is composed of a plurality of circuit chips being annularly arranged.

According to the fan having the integrated fan blade provided by the present invention, the stator pivoting member is an axis, and the fan blade pivoting member is a sleeve.

According to the fan having the integrated fan blade provided by the present invention, a wind hood installed at the exterior of the fan blade is further provided.

According to the fan having the integrated fan blade provided by the present invention, the wind hood includes a base and a cover; the base is formed with a fasten part for fastening the stator, and the stator pivoting member is disposed in the fasten part for being vertically installed on the base, and one side of the base is formed with a first wind channel; the cover is disposed on the base and formed with a second wing channel corresponding to the fan blade.

According to the fan having the integrated fan blade provided by the present invention, the first and second wing channels are respectively a wind inlet and a wind outlet.

Advantages achieved by the present invention are as followings: the fan blade is integrally made of a magnetic material, so the weight of the fan blade is able to be lighter through being made of single material, the production cost is lowered, the fan operation property can be effectively improved and the product quality can be ensured.

DETAILED DESCRIPTION OF THE INVENTION

Preferred embodiments of the present invention will be described with reference to the drawings.

Figure 1:
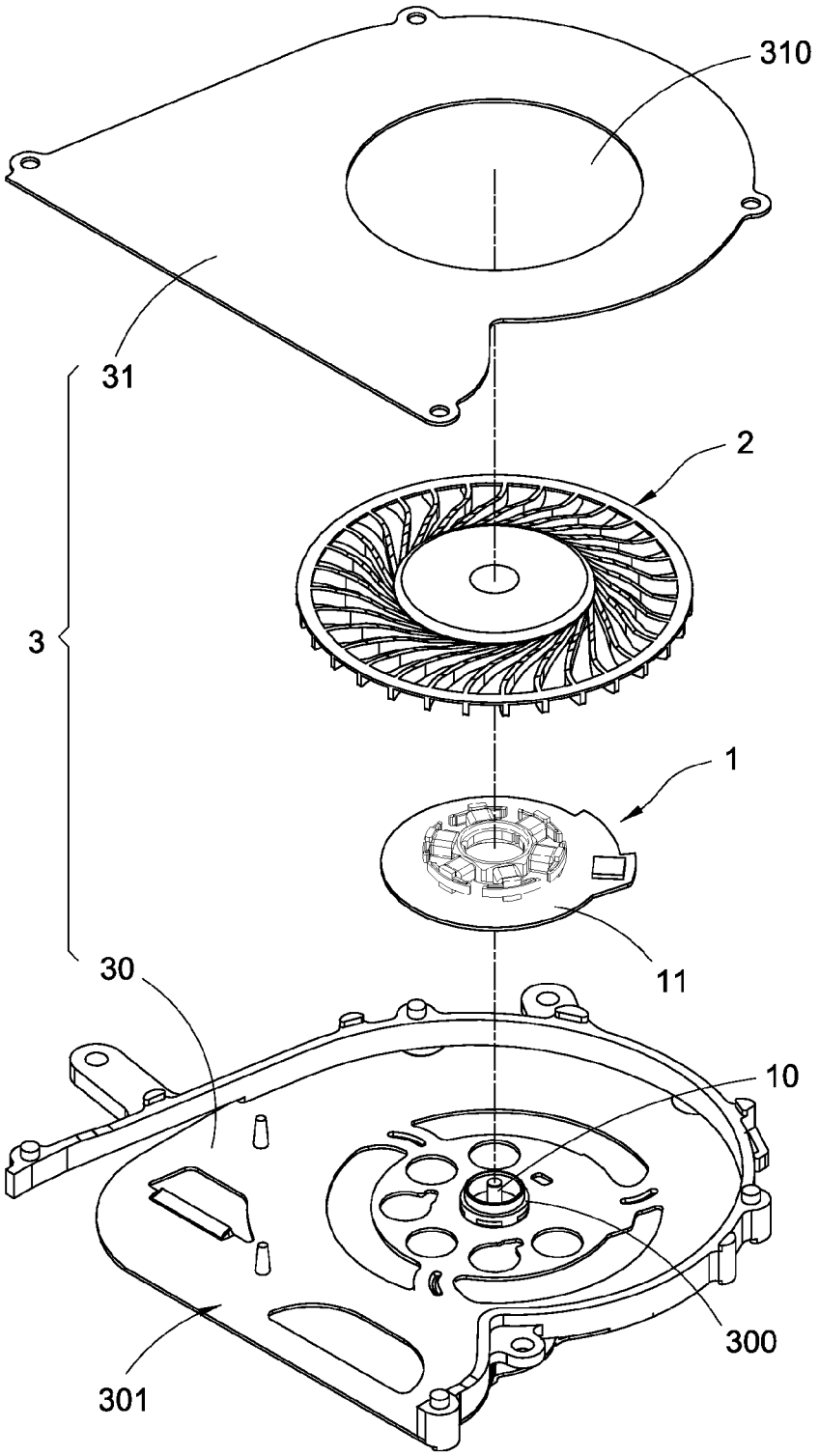
FIG. 1 is a perspective exploded view showing a fan according one embodiment of the present invention.
Figure 2:
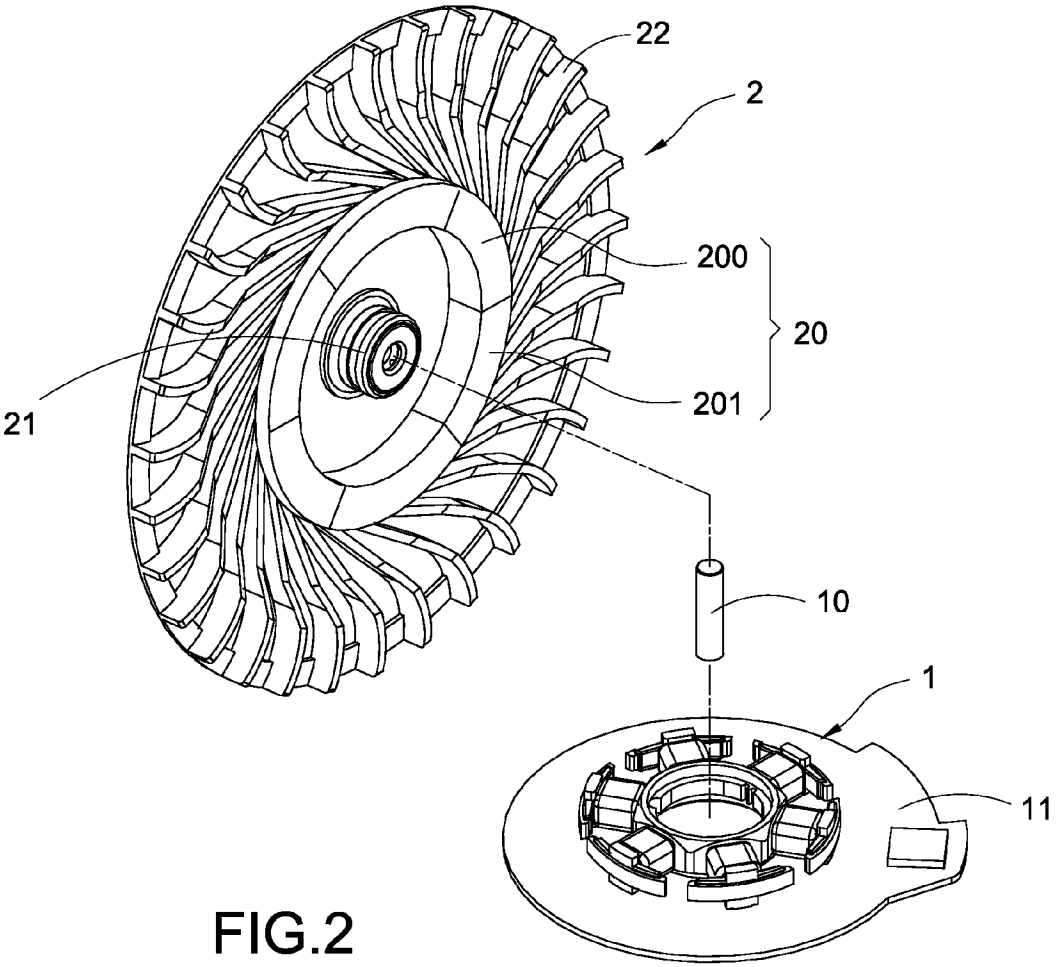
FIG. 2 is another perspective exploded view showing the fan according one embodiment of the present invention.
Figure 3:
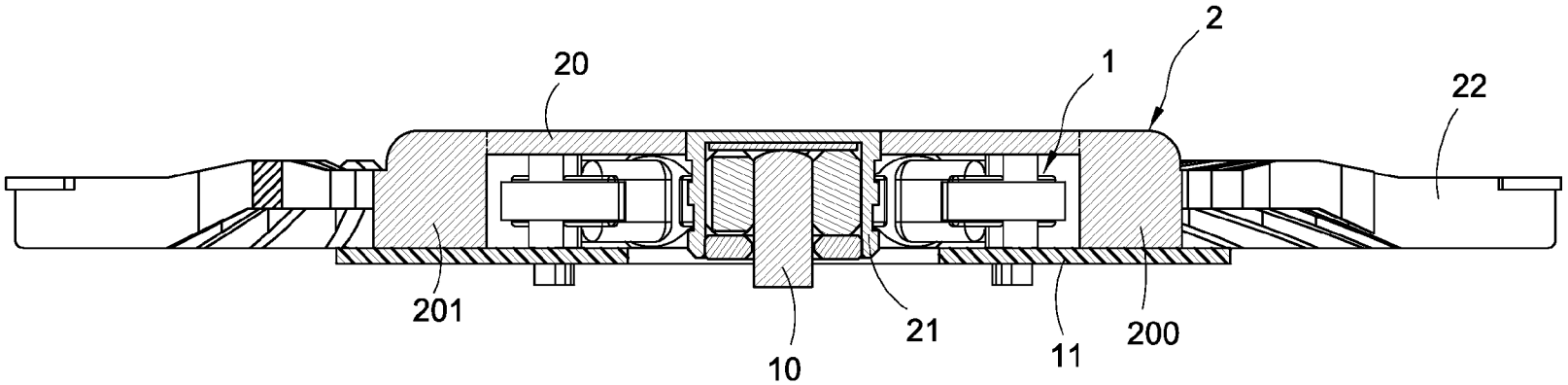
FIG. 3 is a cross sectional view showing the assembly of the fan according one embodiment of the present invention.

Please refer from FIG. 1 to FIG. 3, wherein FIG. 1 is a perspective exploded view showing a fan according one embodiment of the present invention; FIG. 2 is another perspective exploded view showing the fan according one embodiment of the present invention; and FIG. 3 is a cross sectional view showing the assembly of the fan according one embodiment of the present invention. The present invention provides an integrated fan blade and a fan having the same. The fan includes a stator (1) and a fan blade (2).

The stator (1) is served as a motor for driving the fan and can be composed of a silicon steel sheet being wound with coils, and the center thereof is provided with a stator pivoting member (10). The stator pivoting member (10) can be served as an axis and allow the stator (1) to be fastened on a circuit board (11), and the stator (1) is electrically connected to the circuit board (11) for enabling the stator (1) to be controlled through the circuit board (11) for being whether electrically charged to generate an electromagnetic effect so as to drive the fan blade (2) to be operated.

The fan blade (2) is integrally formed with a magnetic material area (e.g. magnetic powders), and the fan blade (2) includes a blade wheel (20), a fan blade pivoting member (21) formed at the center of the blade wheel (20) and axially extended, and a plurality of blade pieces (22) annularly formed at the outer periphery of the blade wheel (20). The above-mentioned fan blade pivoting member (21) can be a sleeve so as to be pivoted with the stator pivoting member (10) of the stator (1) through the fan blade pivoting member (21).

In addition, the fan further includes a wind hood (3). The above-mentioned wind hood (3) is installed at the exterior of the fan blade (2) and includes a base (30) and a cover (31). The base (30) is formed with a fasten part (300) allowing the stator (1) to be fastened thereon and allowing the stator pivoting member (10) to be vertically installed on the base (30), and one side of the base (30) is formed with a first wind channel (301). The cover (31) is disposed on the base (30) and formed with a second wing channel (310) corresponding to the fan blade (2). The above-mentioned first and second wing channels (301), (310) can respectively be a wind inlet and a wind outlet which can be arranged according to the actual rotating direction of the fan blade (2).

As shown in FIG. 2 and FIG. 3, according to this embodiment, the magnetic material area of the fan blade (2) is formed at the periphery of the blade wheel (20) of the fan blade (2) and composed of a plurality of N-pole zones (200) and a plurality of S-pole zones (201) being annularly and staggeringly arranged so as to be surrounded at the lateral periphery of the stator (1); as such, the blade wheel (20) of the fan blade (2) is provided with the magnetism of the N-pole zones (200) and the S-pole zones (201) for being operated through the electromagnetic effect generated by the stator (1) being electrically charged. It is known that the N-pole zones (200) and the S-pole zones (201) can also be formed on each of the blade pieces (22), so each of the blade pieces (22) is provided with magnetism thereby enabling the electromagnetic induction to be formed by the stator (1) and each of the blade pieces (22).

Figure 4:
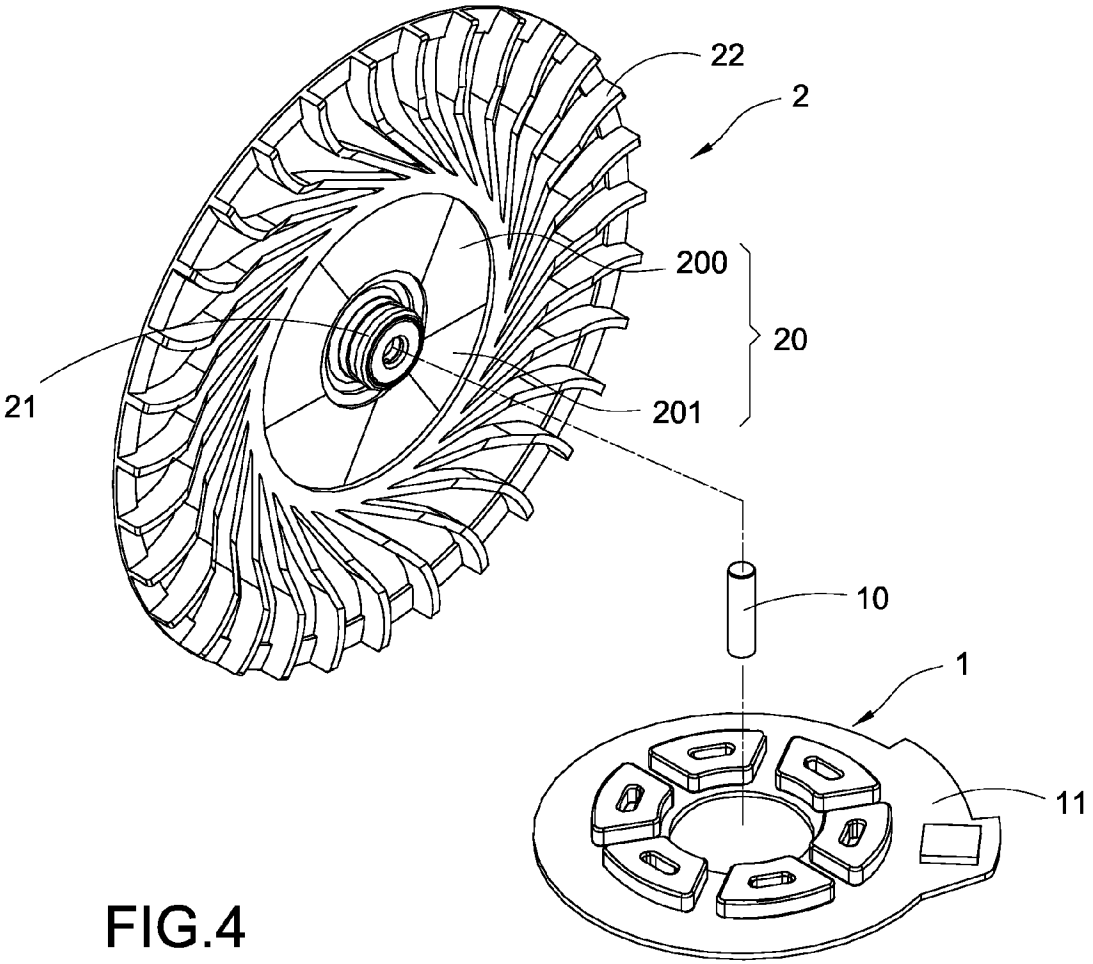
FIG. 4 is a perspective exploded view showing the fan according another embodiment of the present invention.
Figure 5:
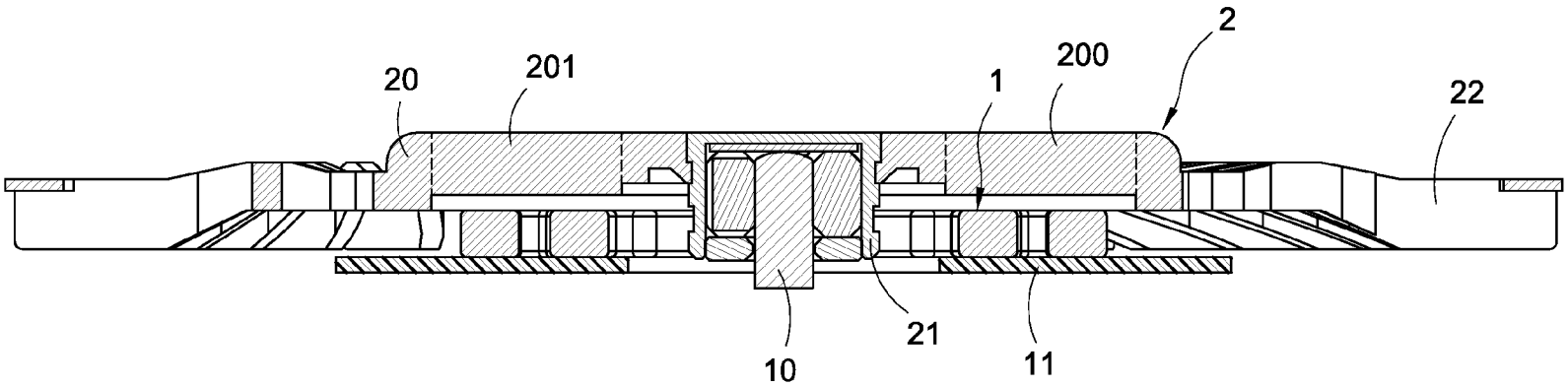
FIG. 5 is a cross sectional view showing the assembly of the fan according another embodiment of the present invention.

Please refer to FIG. 4 and FIG. 5, according to another embodiment of the present invention, the magnetic material area of the fan blade (2) is formed on the top surface of the blade wheel (20) of the fan blade (2) and composed of the plurality of N-pole zones (200) and the plurality of S-pole zones (201) being annularly and staggeringly arranged so as to be surrounded at the top of the stator (1); as such, the above-mentioned objective can also be achieved. In addition, the stator (1) can be composed of a plurality of circuit chips being annularly arranged.

Accordingly, with the above-mentioned structure, the integrated fan blade and the fan having the same are provided.

According to the integrated fan blade and the fan having the same provided by the present invention, the fan blade is integrally formed with the magnetic material area, so the production procedure for the fan blade can be reduced and the component assembly can be simplified for lowering the production cost; and the adopted material has lighter weight so the gross weight of the fan blade can be reduced for allowing the fan operation to be smoother and avoiding the occurrence of noise, thus the fan operating property can be effectively improved and the product quality can be ensured.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An integrated fan blade, including:

a blade wheel (20);

a fan blade pivoting member (21), formed at the center of the blade wheel (20); and a plurality of blade pieces (22), annularly formed at the outer periphery of the blade wheel (20);

wherein, the blade wheel (20), the fan blade pivoting member (21), and the blade pieces (22) are integrally formed in one piece with a magnetic material area; and wherein the magnetic material area is formed at an outer periphery of the blade wheel (20) as a circular wall between the blade pieces (22) and the blade wheel, and the circular wall is composed of a plurality of N-pole zones (200) and a plurality of S-pole zones (201) annularly and staggeringly arranged.

2. The integrated fan blade according to claim 1, wherein the magnetic material area is provided with magnetic powders.

3. A fan having an integrated fan blade, including:

a stator (1), provided with a stator pivoting member (10), the stator (1) being disposed on a circuit board (11) and electrically connected to the circuit board (11); and a fan blade (2), including a blade wheel (20), a fan blade pivoting member (21) formed at the center of the blade wheel (20), and a plurality of blade pieces (22) annularly formed at the outer periphery of the blade wheel (20), and the fan blade pivoting member (21) being pivoted with the stator pivoting member (10);

wherein, the blade wheel (20), the fan blade pivoting member (21), and the blade pieces (22) are integrally formed in one piece with a magnetic material area; and wherein the magnetic material area is formed at an outer periphery of the blade wheel (20) as a circular wall between the blade pieces (22) and the blade wheel, and the circular wall is composed of a plurality of N-pole zones (200) and a plurality of S-pole zones (201) annularly and staggeringly arranged.

4. The fan having the integrated fan blade according to claim 3, wherein the magnetic material area is provided with magnetic powders.

5. The fan having the integrated fan blade according to claim 4, wherein the stator (1) is composed of a silicon steel sheet being wound with coils.

6. The fan having the integrated fan blade according to claim 4, wherein the stator (1) is composed of a plurality of circuit chips being annularly arranged.

7. The fan having the integrated fan blade according to claim 4, wherein the stator pivoting member (10) is an axle and the fan blade pivoting member (21) is a sleeve.

8. The fan having the integrated fan blade according to claim 4, further including a wind hood (3) installed at the exterior of the fan blade.

9. The fan having the integrated fan blade according to claim 8, wherein the wind hood (3) includes a base (30) and a cover (31); the base (30) is formed with a fasten part (300) for fastening the stator (1), and the stator pivoting member (10) is disposed in the fasten part (300) on the base (30), and one side of the base (30) is formed with a first wind channel (301); the cover (31) is disposed on the base (30) and formed with a second wind channel (310) corresponding to the fan blade (2).

10. The fan having the integrated fan blade according to claim 9, wherein the first and second wind channels (301), (310) are respectively a wind inlet and a wind outlet.

* * * * *